US005300235A

United States Patent [19]

Clewlow et al.

[11] Patent Number: 5,300,235

[45] Date of Patent: Apr. 5, 1994

[54] CORROSION INHIBITORS

[75] Inventors: Paul J. Clewlow, Faringdon; John A. Haselgrave; Niall Carruthers, both of Abingdon; Terence M. O'Brien, Oxfordshire, all of England

[73] Assignee: Exxon Chemical Patents Inc., Linden, N.J.

[21] Appl. No.: 882,833

[22] Filed: May 14, 1992

[30] Foreign Application Priority Data

Feb. 8, 1991 [GB] United Kingdom ..... 9116684

[51] Int. Cl.[5] ..... C23F 11/14

[52] U.S. Cl. ..... 252/8.555; 208/47; 252/394; 252/396; 422/16; 540/450; 540/491; 544/224; 560/171; 562/553; 562/571

[58] Field of Search ..... 544/224; 540/484, 450, 540/470; 548/100; 422/16; 252/394, 396, 8.555; 562/571, 553; 560/171; 208/47

[56] References Cited

U.S. PATENT DOCUMENTS

| | | | |
|---|---|---|---|
| 2,995,603 | 8/1961 | Hutchison | 252/8.555 X |
| 3,278,478 | 10/1966 | Masterson et al. | 560/171 |
| 3,522,022 | 7/1970 | May et al. | 252/392 X |
| 3,623,979 | 11/1990 | Maddox, Jr. | 252/8.555 |
| 3,758,493 | 9/1973 | Maddox | 252/390 X |
| 3,766,053 | 10/1973 | Seffens | 422/9 X |
| 3,787,227 | 1/1974 | Marans | 106/14.13 X |
| 3,819,328 | 6/1974 | Go | 422/3 |
| 3,894,849 | 7/1975 | Polss | 252/392 |
| 4,118,222 | 9/1978 | Caruso | 148/403 |
| 4,547,224 | 10/1985 | Schilling | 252/311.5 X |
| 5,027,901 | 7/1991 | French et al. | 166/310 |
| 5,064,571 | 11/1991 | Speranza et al. | 252/392 |
| 5,068,416 | 11/1991 | Baur et al. | 562/571 |

*Primary Examiner*—Robert L. Stoll
*Assistant Examiner*—Valerie Fee
*Attorney, Agent, or Firm*—R. L. Graham

[57] ABSTRACT

Amine derivatives which are compounds of the formula (I):

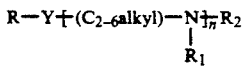

(I)

in which R is a $C_{6-20}$ hydrocarbon;
Y is —CO—NH— and n is an integer of 1 to 6; or

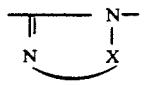

in which X is an alkylene group of 2 to 6 carbon atoms and n is an integer of 0 to 6;
each $R_1$ is independently H, $—(CH_2)_{1-4}COOH$, a $C_{6-20}$ hydrocarbon or $C_{6-20}$ hydrocarbon-carbonyl;
$R_2$ is H, $(CH_2)_{1-4}COOH$ or $C_{6-20}$ hydrocarboncarbonyl;
the compound containing at least one $(CH_2)_{1-4}COOH$ group; or a salt thereof are useful in inhibiting corrosion of metals in oil- and gas-field applications, and also show low toxicity to marine organisms.

13 Claims, No Drawings

CORROSION INHIBITORS

The present invention relates to compounds and compositions which are useful as corrosion inhibitors in oil and gas-field applications, in particular in situations where they may come into contact with the natural environment e.g. by discharge of produced water, and to a method of inhibiting corrosion using these materials.

In order to preserve metals, and particularly ferrous metals, in contact with corrosive liquids in gas- and oil-field applications, corrosion inhibitors are added to many systems, e.g. cooling systems, refinery units, pipelines, steam generators and oil production units. A variety of corrosion inhibitors are known. For example, GB-A-2009133 describes the use of a composition which comprises an aminecarboxylic acid such as dodecylamine propionic acid, and a nitrogen-containing compound containing an organic hydrophobic group, such as N-(3-octoxypropyl)propylenediamine or a cyclic nitrogen-containing compound such as morpholine, cyclohexylamine or an imidazoline.

U.S. Pat. No. 3,445,441 describes amino-amido polymers which are the reaction product of a polyamine and an acrylate-type compound, which polymers may be cross-linked. The polymers have several uses including use as corrosion inhibitors.

Although corrosion inhibitors of many types are known, the materials which have been found most effective in practice have the disadvantage of toxicity to the environment. Toxicity to the marine or freshwater environment is of particular concern. In gas and oil field applications, much work is done off shore or on the coast. If a corrosion inhibitor enters the sea or a stretch of fresh water, then, even at relatively low concentrations, the corrosion inhibitor can kill microorganisms, fish, or other aquatic life, causing an imbalance in the environment. Attempts have therefore been made to identify materials which are successful corrosion inhibitors but at the same time are less toxic to the environment than known inhibitors. The applicants have found that adducts of a fatty amine derivative, e.g. a fatty imidazoline, and an unsaturated acid, optionally containing further amine groups between the heterocyclic and acid groups, and in which the product contains preferably no primary amino groups and, more preferably no secondary groups, has a lower toxicity to the environment (referred to as ecotoxicity), than many known corrosion inhibitors.

The present invention provides compounds which are the product of a condensation reaction between a di- or polyamine and a fatty acid, subsequently reacted with an unsaturated carboxylic acid or halocarboxylic acid, preferably chloro acid.

The present invention therefore provides an amine derivative which is a compound of the formula (I):

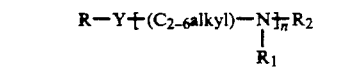

$$R-Y\left[(C_{2-6}\text{alkyl})-\underset{\underset{R_1}{|}}{N}\right]_n R_2 \qquad (I)$$

in which R is a $C_{6-20}$ hydrocarbon;

Y is —CO—NH— and n is an integer of 1 to 6; or Y is

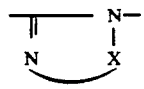

in which X is an alkylene group of 2 to 6 carbon atoms and n is an integer of 0 to 6;

each $R_1$ is independently H, $-(CH_2)_{1-4}COOH$, a $C_{6-20}$ hydrocarbon or $C_{6-20}$ hydrocarbon-carbonyl;

$R_2$ is H, $(CH_2)_{1-4}COOH$ or $C_{6-20}$ hydrocarbon-carbonyl;

the compound containing at least one $(CH_2)_{1-4}COOH$ group; or a salt thereof.

In the amine derivative the hydrocarbon group or groups are from 6 to 20 carbon atoms, may be straight or branched, saturated or unsaturated, and may be aliphatic or may contain 1 or more aromatic groups. Preferably the hydrocarbon group is straight chain aliphatic and is saturated or partially unsaturated. It is preferred that the hydrocarbon contains 12 to 20 carbon atoms, and particularly 16 to 20 carbon atoms.

More preferably, R is the hydrocarbon residue of a naturally occurring fatty acid, which is optionally hydrogenated e.g. the residue of caproic, caprylic, capric, lauric, myristic, palmitic, stearic, palmitoleic, oleic, linoleic or linolenic acid. Conveniently, the compounds can be formed from fatty acids which are readily available and in which the fatty portion is a mixture of hydrocarbon groups. For example, coconut oil, beef tallow or tall oil fatty acids are readily available.

R may also be derived from naphthenic acid (also called NAPA), a derivative of the petroleum refining process.

The amine derivative may contain a heterocyclic group of the formula

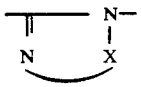

In this formula X may be an alkylene group of 2 to 6 carbon atoms e.g. ethylene or propylene. When X is ethylene, the heterocyclic group is imidazoline. X may be straight chain or may be branched, such that the heterocyclic ring is substituted by an alkyl of up to 4 carbon atoms.

The derivative of formula I may contain one or more amido groups.

$R_1$ in the derivative of formula I is preferably H or a carboxylic acid group of 2 to 5 carbon atoms. Tests currently appear to indicate tertiary groups are less toxic than secondary amino groups, which are in turn less toxic than primary amino groups. If a heterocyclic ring is present the nitrogen atoms in the ring are considered tertiary. In view of the favorable results shown for N-tertiary. In view of the favorable results shown for N-substitution it is preferred that each $R_1$ is a carboxylic acid group. Conveniently, $R_1$ is derived from acrylic acid, in which case $R_1$ in formula I is $-CH_2CH_2COOH$. $R_2$ is similarly conveniently derived from acrylic acid and is therefore preferably $-CH_2CH_2COOH$ or H.

The derivative may optionally contain 1 or more alkyl amino groups between the group Y and the group $R_2$. Each amino group may be optionally substituted by an acid group or a $C_{6-20}$ hydrocarbon or $C_{2-60}$ hydrocarbon-carbonyl. Preferably the derivative contains 2 or 3 amino groups i.e. n is 2 or 3.

The $C_{2-6}$alkyl group linking the group Y and each amino group (if present), may be a straight or branched alkyl group. Conveniently, it is an ethylene, propylene or hexylene group since the starting amines to produce such compounds are either available commercially or can be readily synthesised.

The derivative may be present in the form of a salt, for example an alkali metal salt such as sodium or potassium, an alkaline earth metal salt such as magnesium or calcium, or an ammonium salt.

Particularly preferred derivatives are those of formula (II):

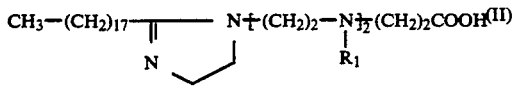

(II)

where each $R_1$ is H or $(CH_2)_2COOH$.

The present invention also provides a method of inhibiting corrosion of a metal by a liquid, preferably in a marine or freshwater environment, which comprises providing in the liquid an amine derivative as defined above. The present invention further provides the use as a corrosion inhibitor in a marine or freshwater environment of an amine derivative a defined above.

Use in a marine or freshwater environment is intended to mean use in an environment in which the compound in normal circumstances is likely to come into contact with an area of seawater or freshwater including during the time the compound is acting to inhibit corrosion and after its disposal.

Compounds of the formula I may conveniently be produced by reacting an amine or a heterocyclic compound with an unsaturated acid. This may be represented as reacting a compound of the formula (III):

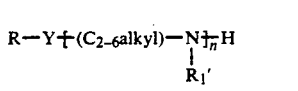

(III)

in which R, Y and n are as defined above and each $R_1'$ is independently H, $C_{6-20}$ hydrocarbon, or $C_{6-20}$ hydrocarboncarbonyl with a compound of the formula (IV):

$$CH_2{=}CR'{-}(CHR')_m{-}COZ \qquad (IV)$$

in which m is 0, 1 or 2, each R' is hydrogen or, when m is 1, R' may be methyl, and Z is OH or alkoxy. If Z is alkoxy the product is hydrolysed to produce the corresponding acid The salt, if desired may be formed using processes known in the art.

The amine derivatives may also be produced by reacting a compound of the formula III as defined above with a compound of the formula V:

$$Q{-}[(CH_2)_{1-4}]{-}COOH \qquad (V)$$

where Q is halogen, preferably chloro, and optionally forming a salt thereof.

The molar ratio of acid of formula IV or V to compound of formula III should be chosen to ensure that the desired level of N-substitution takes place. N-atoms which are part of an amide group will not react with the acid but any other —NH— groups will react. Typically therefore to avoid the presence of primary amino groups the molar ratio will be at least 1:1 when n is 0 or 1 in the starting compound, more preferably 2:1 when n is 1 and $R'_1$ is H. A slight molar excess (e.g. about 10%) of acid is generally used, e.g. for n=1 and $R_1'$ equals H, the acid is preferably used in a molar ratio of about 2.2:1.

Preferably the compounds of formula I are made by reacting the compounds of formula III and IV since if the chloro acid is used as a starting material it is generally difficult to remove all the chlorine-containing material from the product, and chlorine-containing compounds can damage the environment. Preferably, the compound of formula IV is acrylic acid.

The reaction of compounds of formula III and IV or V may be undertaken by dissolving the compound of formula II in a convenient solvent, e.g. secondary butanol, adding the acid and heating the mixture until the reaction is complete. The reaction may be carried out at temperatures of from room temperature up to the reflux temperature of the reaction mixture, typically 60° C. to 120° C.

The starting compounds of formula III may be synthesised by reacting a fatty acid with an alkyl amine. Suitable fatty acids are those indicated on page 3, with respect to the derivation of R. In particular, tall oil fatty acid (TOFA) and oleic acid are suitable starting materials. The acid and amine initially react to produce an amide i.e. a compound of the formula III in which Y is —CO—NH—. Dehydrolysis of the amide results in cyclisation to give a compound of the formula III in which Y is a heterocyclic ring. An incomplete cyclisation reaction results in a mixture of compounds of formula III in which Y is an amide group and those in which Y is a heterocyclic ring. Some starting material and some mono-, di- or polyamides may also be present, depending on the starting amine in the system. This mixture may be used to produce a successful corrosion inhibitor.

The alkyl amine is chosen to give the appropriate heterocyclic ring and/or amide group(s) and, if desired, alkyl amine group attached to the heterocyclic ring or amide. Suitable alkyl amines include e.g. ethylene diamine, diethylenetriamine (DETA), triethylenetetraamine (TETA) and tetraethylenepentamine (TEPA).

The reaction of the fatty acid and an alkyl amine may be carried out by heating the reactants in a suitable solvent e.g. an aromatic hydrocarbon. The reaction may be carried out initially at the reflux temperature of the mixture, e.g. 140° C. to 180° C., and the temperature may be increased to e.g. 200° to 230° C. to form the heterocyclic ring.

The present invention also provides a composition suitable for use as a corrosion inhibitor comprising an amine derivative as described above, and a carrier or diluent. The amine derivative may be present in the composition in the form of a solution or dispersion in water and/or an organic solvent. Examples of suitable solvents are alcohols such as methanol, ethanol, isopropanol, isobutanol, secondary butanol, glycols and aliphatic and aromatic hydrocarbons. The solubility of the compounds in water can be improved by forming a salt e.g. a sodium, potassium, magnesium or ammonium salt.

The amount of active ingredient in the composition required to achieve sufficient corrosion protection varies with the system in which the inhibitor is being used. Methods for monitoring the severity of corrosion in different systems are well known, and may be used to decide the effective amount of active ingredient required in a particular situation. The compounds may be used to impart the property of corrosion inhibition to a composition for use in an oil or gas field application and which may have one or more functions other than corrosion inhibition, e.g. scale inhibition.

In general it is envisaged that the derivatives will be used in amounts of up to 1000 ppm, but typically within the range of 1 to 200 ppm.

In the compositions the derivatives may be used in combination with known corrosion inhibitors, although to achieve the low ecotoxicity which is desirable, it is preferred that the composition contains only corrosion inhibitors which have low ecotoxicity.

The compositions may contain other materials which it is known to include in corrosion inhibiting compositions e.g. scale inhibitors and/or surfactants. In some instances, it may be desirable to include a biocide in the composition.

The compositions may be used in a variety of petroleum operations in the gas and oil industry. They can be used in primary, secondary and tertiary oil recovery and be added in a manner known per se. Another technique in primary oil recovery where they can be used is the squeeze treating technique, whereby they are injected under pressure into the producing formation, are adsorbed on the strata and desorbed as the fluids are produced. They can further be added in the water flooding operations of secondary oil recovery as well as be added to pipelines, transmission lines and refinery units.

The amine derivatives have been found to be effective corrosion inhibitors under sweet, sweet/sour, brine and brine/hydrocarbon oil field conditions. Toxicity testing has also shown them to be of a lower toxicity to marine organisms than other existing oil field corrosion inhibitors. The following examples illustrate the stages in production of a heterocyclic derivative.

EXAMPLE (i) Preparation of imidazoline amine

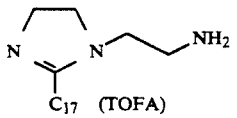

REACTANTS

TOFA (tall oil fatty acid)$C_{18}CO_2H$—238.4 g (0.8M)
DETA (diethylene triamine) $(H_2NCH_2CH_2)_2NH$—90.79 g; (0.88M, 1.1 eq)
SOLVESSO 100 (aromatic hydrocarbons)—82 g

METHOD

To a stirring solution of TOFA (238.4 g) in Solvesso 100 (82 g) at room temperature under $N_2$ was added DETA (90.79 g). A slight temperature rise was observed and also a slight color change (pale yellow to pale orange). The stirring solution was then heated to reflux (160° C.).

After refluxing for about 1½ hours approximately 15 ml of a milky emulsion was obtained. The temperature was increased to 210° C. to remove the second mole of $H_2O$ to form the required imidazoline.

(ii) SYNTHESIS OF TOFA/TETA IMIDAZOLINE PLUS 3EQ. ACRYLIC ACID

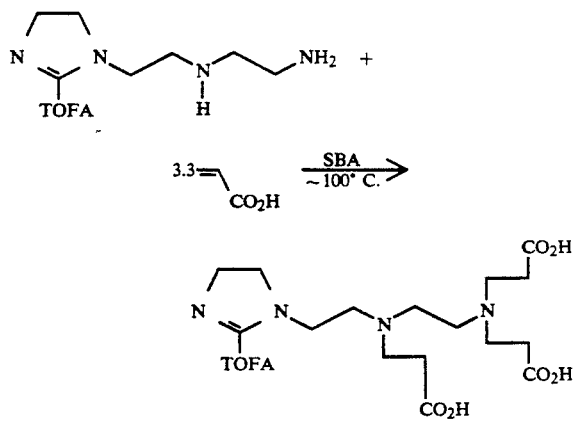

REAGENTS

TOFA/TETA IMIDAZOLINE (80% in solvesso 100) 145 g (0.25M)
ACRYLIC ACID: 59.4 g (0.825M, 3.3 eq).
Secondary Butanol (SBA): 205 g

METHOD

A solution of TOFA/TETA imidazoline (145 g) in SBA (205 g) was stirred at room temperature under $N_2$. To this was carefully added, dropwise, acrylic acid (59.4 g). A temperature rise from 26° C. to 41° C. was observed.

After exotherms had ceased, the reaction temperature was raised to reflux (about 100° C.). The reaction was monitored to completion using thin layer chromatography (TLC). (1:1 acetone/heptane, silica gel plate, $I_2$ development).

CORROSION INHIBITION TESTS

Corrosion inhibition was measured using an LPR bubble test.

The LPR "bubble test" apparatus consists of several 1 liter cylindrical Pyrex glass vessels. Brine (800 ml) is added to each pot and carbon dioxide gas bubbled into the system whilst heating to 80° C. After oxygen has been removed (e.g. half an hour at 80° C.), cylindrical mild steel probes are inserted into the hot brine and kerosene (200 ml) carefully poured on top of the aqueous phase. Other hydrocarbons e.g. crude oil can be used instead of kerosene. If a "sweet" test is required, the system is now sealed. However, for a "sour" test, the equivalent of 50 ppm hydrogen sulphide is now added (in the form of an aqueous 12% sodium sulphide solution) before sealing the vessel and turning off the $CO_2$. Corrosion rate readings (in mpy) are now initiated using a linear polarisation meter and recorder. Readings are then taken throughout the course of an experimental run. After three hours, the rate of corrosion has usually achieved equilibrium and a blank corrosion rate is taken. 10 ppm of corrosion inhibitor (30% actives) is now injected into the hydrocarbon phase of the system to test the water partitioning properties of each chemical. Each test is run for 24 hours. Percentage protection values are calculated at +2 hours and +16 hours after the addition of product.

TABLE 1

| EX | COMPOSITION | CORROSIVE AGENTS | % PROTECTION +2 HRS | % PROTECTION +16 HRS |
|---|---|---|---|---|
| 1 | TOFA/TETA imidazoline + 1 equivalent of acrylic acid (Na salt) | Sweet<br>Sweet/Sour | 59%<br>32% | 83%<br>98% |
| 2 | TOFA/TETA imidazoline + 2 equivalents of acrylic acid (Na salt) | Sweet<br>Sweet/Sour | 69%<br>72% | 86%<br>95% |
| 3 | TOFA/TETA imidazoline + 3 equivalents of acrylic acid (Na salt) | Sweet<br>Sweet/Sour | 96%<br>21% | 99%<br>83% |
| 4 | TOFA/TEPA imidazoline + 1 equivalent of acrylic acid (Na salt) | Sweet<br>Sweet/Sour | 65%<br>73% | 86%<br>80% |
| 5 | TOFA/TEPA imidazoline + 4 equivalents of acrylic acid (Na salt) | Sweet<br>Sweet/Sour | 98.5%<br>— | 99.6%<br>— |
| 6 | TOFA/DETA imidazoline + 1 equivalent of acrylic acid (Na salt) | Sweet<br>Sweet/Sour | 63%<br>43% | 74%<br>68% |
| 7 | TOFA/DETA imidazoline + 2 equivalents of acrylic acid (Na salt) | Sweet<br>Sweet/Sour | 99%<br>— | 99%<br>— |
| 8 | NAPA/DETA imidazoline + 1 equivalent of acrylic acid (Na salt) | Sweet<br>Sweet/Sour | 39% | 48% |

ECOTOXICITY

The toxicity of the compounds was measured by assessing the concentration of each compound required to kill 50% of the microorganism *Tisbe Battagliai.* This concentration is termed the LC50 and is expressed in mg/l. The results are given in Table 2.

TABLE 2

| SAMPLE IDENTIFICATION | TIME (HRS) | CATEGORY OF $LC_{50}$ (mg/l) <10 | 10–100 | 100–1000 |
|---|---|---|---|---|
| Example 1 | 24 | | √ | |
| | 48 | | √ | |
| Example 2 | 24 | | | √ |
| | 48 | | √ | |
| Example 3 | 24 | | | √ |
| | 48 | | | √ |

It can be seen from this that the addition of more acrylic acid groups (i.e. increasing the N-substitution) gives lower toxicity.

What is claimed is:

1. A method of inhibiting corrosion of a ferrous metal by a fluid encountered in petroleum operations, which comprises:

(a) introducing into the fluid inhibiting amounts of an amine corrosion inhibitor comprising a compound having the formula of $$R-Y\left[(C_{2-6}\text{alkyl})-\underset{\underset{R_1}{|}}{N}\right]_n R_2$$

in which n is an integer of 1 to 6; R is a $C_{6-20}$ hydrocarbon group;

$R_1$ is selected from the group consisting of (i) $(CH_2)_{1-4}COOH$, (ii) a $C_{6-20}$ hydrocarbon group, and (iii) a $C_{6-20}$ hydrocarbon-carbonyl group having the formula of $$R_3-\overset{\overset{O}{\|}}{C}$$

where $R_3$ is a $C_{5-19}$ hydrocarbon group; $R_2$ is selected from the group consisting of $(CH_2)_{1-4}COOH$, and $C_{6-20}$ hydrocarbon carbonyl group having the formula of $$R_3-\overset{\overset{O}{\|}}{C}$$

where $R_3$ is a $C_5$–$C_{19}$ hydrocarbon group; and Y is selected from the group consisting of

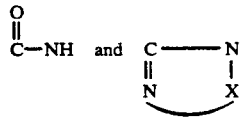

in which X is an alkylene group of 2 to 6 carbon atoms, the compound containing at least one $(CH_2)_{1-4}COOH$ or a salt of an alkali metal, an alkaline earth metal or ammonium thereof; and (b) contacting metal with the fluid containing the corrosion inhibitor.

2. The method of claim 1 in which R is a hydrocarbon of 16 to 20 carbon atoms.

3. The method of claim 1 in which R is a hydrocarbon obtainable from tall, oil, coconut oil, beef tallow or naphthenic acid.

4. The method of claim 1 in which $R_1$ and $R_2$ are each $(CH_2)_2$—COOH.

5. The method of claim 1 in which n is 2 or 3.

6. The method of claim 1 in which Y is an imidazoline group.

7. The method of claim 1 wherein the corrosion inhibitor is a compound of the formula (II):

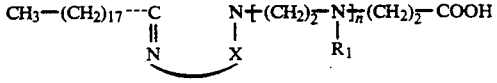

(II)

wherein $R_1$ is —$(CH_2)_2$—COOH; or salt thereof and X and n are as defined in claim 1.

8. The method of claim 1 wherein the amine corrosion inhibitor is the product of a condensation reaction between a di- or polyamine and a fatty acid, subsequently reacted with an unsaturated carboxylic acid or halocarboxylic acid.

9. The method of claim 1 wherein the corrosion inhibitor is produced by:

(i) reacting an amino compound of the formula $$R-Y-\left[(C_{2-6}\text{alkyl})-\underset{\underset{R_1'}{|}}{N}\right]_n H$$

in which Y, R and n are defined as in claim 1 and $R_1'$ is selected from the group consisting of H, a $C_{6-20}$ hydrocarbon group and a $C_{6-20}$ hydrocarbon carbonyl group, with a compound of the formula:

$$CH_2{=}CR^1-COZ$$

$R^1$ is hydrogen and Z is OH or alkoxy; (ii) when Z is alkoxy, hydrolysing the reaction product of said compounds.

10. The method of claim 9 and further comprising the step of (iii) forming a salt of the hydrolysed product by adding a base thereto.

11. The method of claim 1 wherein the liquid is an oil field fluid including oil and water and further comprising the steps of separating water from the produced fluid and discharging a portion at least of the separated water containing an amine corrosion inhibitor into marine or freshwater environments.

12. The method of claim 1 wherein the corrosion inhibitor is produced by reacting a compound of the formula (III):

$$-R---Y-[-(C_{2-6}\text{alkyl})---\underset{\underset{R_1}{|}}{N}]_n-H \qquad \text{(III)}$$

in which R, Y and n are as defined in claim 1 and each $R_1$ is H, $C_{6-20}$ hydrocarbon or $C_{6-20}$ hydrocarbon-carbonyl group having the formula of $$R_3-\overset{\overset{O}{\|}}{C}-$$

where $R_3$ is a $C_5$–$C_{19}$ hydrocarbon with a compound of the formula V:

$$Q-[(CH_2)_{1-4}]-COOH \qquad \text{(V)}$$

where Q is halogeno.

13. A method of inhibiting corrosion of ferrous metal by oil field fluids which comprises:

(a) introducing into the fluids inhibiting amounts of an amine corrosion inhibitor ranging from 1 to 1000 ppm, the corrosion inhibitor being substantially free of primary or secondary nitrogen and having the following formula:

$$R-Y-[-(C_{2-6}\text{alkyl})-\underset{\underset{R_1}{|}}{N}]_n-R_2$$

in which n is 1 to 6; R is a $C_{6-20}$ hydrocarbon group; Y is selected from the group consisting of $$\overset{\overset{O}{\|}}{C}-NH \quad \text{and} \quad \begin{array}{c} C \text{———} N \\ \| \qquad | \\ N \qquad X \end{array}$$

in which X is an alkylene group of 2 to 6 carbon atoms;

$R_1$ is selected from the group consisting of $(CH_2)_{1-4}COOH$, a $C_{6-20}$ hydrocarbon group, and a $C_{6-20}$ hydrocarbon carbonyl group having the formula of $$R_3-\overset{\overset{O}{\|}}{C}$$

where $R_3$ is a $C_5$–$C_{19}$ hydrocarbon;

$R_2$ is selected from the group consisting of $(CH_2)_{1-4}$ COOOH and a $C_{6-20}$ hydrocarbon-carbonyl group having the formula of $$R_3-\overset{\overset{O}{\|}}{C}$$

where $R_3$ is a $C_5$–$C_{19}$ hydrocarbon, the compound containing at least one $(CH_2)_{1-4}$ COOH group or an alkali metal salt, or alkaline earth metal salt, or ammonium salt thereof;

(b) contacting metal with the fluids containing the corrosion inhibitor;

(c) separating water from produced fluids; and (d) disposing of a portion at least of the separated water into a marine or fresh water environment.

* * * * *